United States Patent [19]

French et al.

[11] 4,098,625

[45] Jul. 4, 1978

[54] EXPLOSIVE COMPOSITIONS BONDED WITH FLUOROCARBON POLYMERS

[75] Inventors: John W. French; Judson B. Eldridge, both of China Lake, Calif.

[73] Assignee: The United States of America as represented by the Secretary of the Navy, Washington, D.C.

[21] Appl. No.: 727,743

[22] Filed: May 8, 1968

[51] Int. Cl.[2] ..... C06B 45/10

[52] U.S. Cl. ..... 149/19.3; 149/92; 264/3 B

[58] Field of Search ..... 149/19, 92, 11, 19.3; 264/3 B

[56] References Cited

U.S. PATENT DOCUMENTS

| | | | |
|---|---|---|---|
| 3,291,666 | 12/1966 | Thatcher | 149/92 |
| 3,326,731 | 6/1967 | Noddin | 149/92 X |

*Primary Examiner*—Leland A. Sebastian

*Attorney, Agent, or Firm*—R. S. Sciascia; Roy Miller

[57] ABSTRACT

An explosive composition consisting of a Teflon-Viton binder and a high explosive which can be extruded as well as molded into many shapes and sizes at temperatures ranging from 150° to 250° F. at pressures and rates which are reasonable from a production standpoint.

9 Claims, No Drawings

EXPLOSIVE COMPOSITIONS BONDED WITH FLUOROCARBON POLYMERS

BACKGROUND OF THE INVENTION

The present invention is for an improved plastic-bonded explosive composition which can be extruded as well as molded.

The major components of the old plastic-bonded explosives were nylon and trinitrotrimethylenetriamine (RDX) or nylon and cyclotetramethylenetetranitramine (HMX) with a powdered metal such as aluminum added where increased blast was required. Some later improved plastic-bonded explosives have been developed and used wherein the major components are RDX and HMX and the copolymer of vinylidene fluoride and hexafluoropropylene (Viton) or vinylidene fluoride and chlorotrifluoroethylene (Kel-F elastomer) with a metal added. These later Viton or Kel-F bound high explosives are good high temperature explosives which can be molded or pressed, but are difficult to extrude and the strands which may be extruded are limited in their physical properties. For example, the tensile strength of a ¼ inch diameter strand of a HMX-Kel-F formulation was at best 900 psi and it tended to be erratic probably due to several factors including agglomeration of the Kel-F binder. The present invention provides an improved plastic-bonded high explosive which can be extruded as well as molded into many sizes and shapes of strands or rods.

SUMMARY OF THE INVENTION

This invention relates to extrudable plastic bonded high explosives, and more particularly to an explosive comprising HMX or RDX and a fluorocarbon binder consisting of a mixture of the copolymer of vinylidene fluoride and hexafluoropropylene (hereinafter called Viton) and polytetrafluoroethylene (hereinafter called Teflon). It is a general purpose of the present invention to provide an extrudable plastic-bonded explosive composition which has highly improved physical properties after it has been extruded. Another purpose is to provide an explosive which is resistant to high temperatures, has improved resistance to water absorption and/or to chemical agents, and is of lower sensitivity than other materials or this nature.

DESCRIPTION OF THE INVENTION

In accordance with the present invention the improved composition comprises the following:

| Component | Weight % | Allowable Range |
|---|---|---|
| HMX* or RDX** | 80 | ±5 to 10 |
| Viton-A*** | 15 | ±5 |
| Teflon**** | 5 | ±2 to 5 |

*HMX - Cyclotetramethylenetetranitramine, an explosive with a nominal particle size of 10 - 20μ

***Viton-A - Tradename for the copolymer of vinylidene fluoride and hexafluoropropylene described in an article entitled "Vinylidene fluoride-hexafluoropropylene" by Dixon, Rexford and Rugg in Industrial Engineering and Chemistry, volume 49, pages 1687 to 1690 (1957)

****Teflon - Tradename for polytetrafluoroethylene, described in U.S. Pat. No. 2,230,654

Nothing is really new about the process for preparing the improved composition. Briefly, (1) a predetermined amount of the copolymer of vinylidene fluoride and hexafluoropropylene (Viton-A) is dissolved in a solvent selected from a low-boiling ketone such as acetone and methyl ethyl ketone or a low boiling ester such as ethyl acetate and methyl acetate; (2) a predetermined amount of polytetrafluoroethylene (Teflon) is vigorously stirred into the resulting Viton-A solution to form a slurry of Viton-A and Teflon; (3) a predetermined amount of explosive selected from the group consisting of RDX and HMX is added to said slurry to form a suspension; (4) said suspension is washed for from 5 to 10 minutes with hexane or water, the volume of hexane or water being from one to four times the volume of the suspension; (5) after the suspension has settled decant or siphon off the supernatant hexane or water; and (6) dry the residue at a temperature of about 150° F. for from 4 to 12 hours. The resulting material is ready for extrusion at temperatures ranging from about 150° to 250° F. and at pressures ranging from 2,000 to 20,000 psi in a standard press. The preferred solvent for Viton-A was acetone because it was readily available.

The following examples have been successfully extruded at about 200° F. However, the invention is not restricted to the examples:

EXAMPLE I

| Ingredients | Percent by weight |
|---|---|
| HMX | 80 |
| Viton-A | 15 |
| Teflon | 5 |

This sample extruded easily at about 200° F. into strands ⅛ inch to ¼ inch in diameter. Rods of 1 inch diameter were also extruded. A batch of this composition was extruded in the form of a ¼ inch diameter strand with a total length of slightly over 200 feet and was cut separately into several sections. The strand was extruded through a single port die at a temperature of 185° F. and a pressure of 8,000 psi (average) at an extrusion rate of approximately 1½ feet per minute. Its physical and ballistic properties are as follows:

| | |
|---|---|
| Density | 1.82 g/cc |
| Tensile strength | 1,000 - 1,500 psi |
| Elongation | 20 - 30% |
| Appearance | White, uniform, flexible |
| Differential thermal analysis | Initial endotherm at 190° C. |
| Detonation Velocity | 8,000 meters/sec |

When a ¼ inch diameter strand of the plastic bonded explosive consisting of 80 percent HMX and 20 percent of the copolymer of vinylidene fluoride and chlorotrifluoroethylene (Kel-F) was compared with the above composition the improved physical properties were apparent. For example, the tensile strength of the composition was 1,000 - 1,500 psi as compared to only 800 - 900 psi for the HMX - Kel-F explosive composition.

EXAMPLE II

| Ingredients | Percent by weight |
|---|---|
| RDX in a ratio of 3 parts 120μ particle size to 1 part 20μ particle size | 84 |
| Viton-A | 12 |
| Teflon | 4 |

This sample was extruded into a 1 inch rod for use as a burster medium in a dispenser for dispersing a disabling aerosol cloud. It has about twice as much punch as the standard Composition B which had been previously used and its physical characteristics are similar to those found for the formulation described in Example I. Composition B is described in the manual entitled "Military Explosives," TM-9-1910, TO-11A-1-34, dated April 1955.

EXAMPLE III

| Ingredients | Percent by weight |
|---|---|
| HMX | 68 |
| Aluminum | 12 |
| Viton | 15 |
| Teflon | 5 |

This sample was extruded into a 1/10-inch strand at 19,000 psi.

Teflon gives the extruded high explosives of this invention additional physical strength probably due to fact that at normal temperatures it has a crystalline or fibrous structure which is retained by applicants' process for preparing the improved compositions.

Other high explosives such as diaminotrinitrobenzine (DATB) may also be used in the above formulations.

Obviously many modifications and variations of the present invention are possible in the light of the above teachings. It is therefore to be understood that within the scope of the appended claims the invention may be practiced otherwise than as specifically described.

The invention herein described may be manufactured and used by or for the Government of the United States of America for governmental purposes without the payment of any royalties thereon or therefor.

What is claimed is:

1. A plastic bonded explosive comprising a high explosive selected from the group consisting of trinitrotrimethylenetriamine, cyclotetramethylenetetranitramine and mixtures thereof and a fluorocarbon formulation consisting essentially of a copolymer of vinylidene fluoride and hexafluoropropylene in intimate admixture with polytetrafluoroethylene.

2. The plastic bonded explosive of claim 1 to which aluminum is added.

3. A plastic bonded explosive comprising
trinitrotrimethylenetriamine,
polytetrafluoroethylene,
a copolymer of vinylidene fluoride and hexafluoropropylene, and aluminum.

4. A plastic bonded explosive comprising
cyclotetramethylenetetranitramine,
polytetrafluoroethylene,
a copolymer of vinylidene fluoride and hexafluoropropylene, and aluminum.

5. A plastic bonded explosive comprising
trinitrotrimethylenetriamine,
polytetrafluoroethylene, and
a copolymer of vinylidene fluoride and hexafluoropropylene.

6. A plastic bonded explosive comprising
cyclotetramethylenetetranitramine,
polytetrafluoroethylene, and
a copolymer of vinylidene fluoride and hexafluoropropylene.

7. A plastic bonded explosive consisting essentially of from 70 to 90 percent by weight of an explosive selected from the group consisting of trinitrotrimethylenetriamine,
cyclotetramethylenetetranitramine and diaminotrinitrobenzene; from 10 to 20 percent by weight of the copolymer of vinylidene fluoride and hexafluoropropylene; and
from 3 to 10 percent by weight polytetrafluoroethylene.

8. A plastic bonded explosive consisting essentially of about 80 percent by weight cyclotetramethylenetetranitramine,
about 15 percent by weight of the copolymer of vinylidene fluoride and hexafluoropropylene; and
about 5 percent by weight polytetrafluoroethylene.

9. A plastic bonded explosive consisting essentially of about 84 percent by weight trinitrotrimethylenetriamine;
about 12 percent by weight of the copolymer of vinylidene fluoride and hexafluoropropylene; and
about 4 percent by weight polytetrafluoroethylene.

* * * * *